US005525166A

United States Patent [19]

Cook

[11] Patent Number: 5,525,166

[45] Date of Patent: Jun. 11, 1996

[54] PRYOTECHNIC COMPOSITION AND DEVICE CONTAINING SUCH COMPOSITION

[75] Inventor: Barry Cook, Manchester, Great Britain

[73] Assignee: Standard Fireworks Ltd., Huddersfield, England

[21] Appl. No.: 191,700

[22] Filed: Feb. 4, 1994

[30] Foreign Application Priority Data

Feb. 5, 1993 [GB] United Kingdom ..... 9302294

[51] Int. Cl.[6] ..... C06B 29/02

[52] U.S. Cl. ..... 149/77; 149/83

[58] Field of Search ..... 149/2, 77, 83

[56] References Cited

U.S. PATENT DOCUMENTS

| | | | |
|---|---|---|---|
| H72 | 6/1986 | Wise et al. | 149/61 |
| H227 | 3/1987 | Tracy et al. . | |
| 3,937,771 | 2/1976 | Voigt, Jr. et al. | 264/3 E |
| 3,954,526 | 5/1976 | Mangum et al. | 149/7 |
| 4,238,253 | 12/1980 | Garner | 149/19.6 |
| 4,299,636 | 11/1981 | Hartman et al. | 149/19.4 |
| 4,355,577 | 10/1982 | Ady et al. | 102/378 |
| 4,497,676 | 2/1985 | Kurtz | 149/2 |
| 4,698,108 | 10/1987 | Vega et al. | 149/21 |

FOREIGN PATENT DOCUMENTS

| | | |
|---|---|---|
| 1498171 | 3/1964 | United Kingdom . |
| 1498172 | 11/1965 | United Kingdom . |
| 1202390 | 11/1967 | United Kingdom . |
| 1219386 | 1/1971 | United Kingdom . |
| 1339516 | 12/1973 | United Kingdom . |
| 1601392 | 10/1981 | United Kingdom . |
| 90/15788 | 6/1990 | WIPO . |

*Primary Examiner*—Donald P. Walsh
*Assistant Examiner*—Anthony R. Chi
*Attorney, Agent, or Firm*—Millen, White, Zelano & Branigan

[57] ABSTRACT

A pyrotechnic composition, particularly for fireworks, which contains an organic compound having at least one aromatic group as a binder. The compound preferably has a weight ratio of carbon:hydrogen of at least 10:1 and is substantially free of groups of the formulae COOH or $COO^{-M+}$, wherein $M^+$ is the equivalent of a metal ion. Also, pyrotechnic devices containing such composition.

17 Claims, No Drawings

PRYOTECHNIC COMPOSITION AND DEVICE CONTAINING SUCH COMPOSITION

This invention relates to a pyrotechnic composition, a process for its manufacture, and a device incorporating it. It relates especially to a pyrotechnic composition for fireworks, and more especially to a rocket propellant composition.

BACKGROUND OF THE INVENTION

Conventional fireworks and display rockets are driven by a powder mixture of potassium nitrate, charcoal, and sulphur. Smaller rockets employ a mixture of potassium perchlorate and an alkali metal salt of an aromatic carboxylic acid. This mixture is conventionally modified by the addition of a liquid binder, for example a mineral or vegetable oil, which also reduces the sensitiveness of the composition to impact or friction. Other proposals have been that the composition should contain liquid components that react on mixing to form a solid polymeric binder—see, for example, British Patent Specification No. 1202390. In all such cases, however, the resulting composition is no longer free-flowing and so the rocket casing or other container may not be filled using the advantageous funnel and rammer technique employing a powder dispenser.

SUMMARY OF THE INVENTION

A first aspect of the present invention provides a solid, flowable, elemental sulphur-free pyrotechnic composition which comprises at least three components, one of those components being an at least partially aromatic substance containing carbon and hydrogen in a ratio of at least 10:1 by weight, which component is substantially free of groups of the formulae COOH and $COO^-M^+$, wherein $M^+$represents the equivalent of a metal ion, and acts as a binder.

More especially, the invention provides a composition comprising (a) an organic substance containing at least one aromatic group, especially a compound, having a weight ratio of carbon:hydrogen of at least 10:1 and being substantially free of groups of the formulae COOH and $COO^-$, $M^+$, wherein $M^+$represents the equivalent of a metal ion, (b) an oxidizing agent and, optionally but preferably, (c) an aromatic carboxylic acid or a salt or partial salt thereof.

Advantageously the compound (c) is a different chemical entity from that of component (a). A second aspect of the present invention provides a solid, flowable, elemental sulphur-free pyrotechnic composition which comprises at least three components, one of those components, component a, being an organic substance containing at least one aromatic group and containing carbon and hydrogen in a ratio of at least 10:1 by weight, which component acts as a binder, and another of those components, component b, being an oxidizing agent.

Preferably such a composition also comprises an aromatic carboxylic acid or a salt or a partial salt thereof. Advantageously that compound, component c, is a different chemical entity from that of the binder.

As mentioned above charcoal has traditionally been a component of fireworks and display rockets. Although the presence of charcoal as a component of compositions according to the present invention is not excluded it is preferred that the compositions are free of charcoal.

The present invention further provides a process for the manufacture of a solid mass of a pyrotechnic composition, which comprises pouring a flowable composition as provided by the invention into a container and compacting the flowable composition into a solid mass. Advantageously, compaction takes place simultaneously with pouring, as described in more detail below.

The invention also provides the use of a substance containing carbon and hydrogen in a weight ratio of at least 10:1 as a binder in a solid, flowable, pyrotechnic composition.

The organic substance used as a binder in compositions according to the invention is preferably a compound. That is, it is a substance composed of two or more elements in definite proportions by weight which are independent of the mode of preparation and it is characterizable by its melting point when in a pure form.

It will be appreciated that most organic materials having the required C:H ratio will be aromatic. The substance may be, however, only partially aromatic, i.e., it may have non-aromatic portions, e.g., aliphatic, cycloaliphatic or non-aromatic heterocyclic, provided that the substance as a whole meets the required C:H ratio. The substance, especially the compound, or the aromatic portion thereof, may be carbocyclic or heterocyclic. The substance may be a hydrocarbon or may contain other atoms, for example, oxygen, nitrogen or sulphur, either in the aromatic group or in other parts of the molecule, either interrupting a hydrocarbyl chain or as a substituent thereon. If the molecule is acidic or basic it may be in the form of an acid, base, or salt. If, however, the molecule is other than neutral, it is advantageously basic.

While, for simplicity of manufacture, a single binder is preferred, it is within the scope of the invention to use mixtures of two or more binders. Further, the binder need not be a single identifiable molecular species, and may be, for example, a low molecular weight polymer, provided it is at least partially aromatic and the weight ratio requirement is met.

The substance is advantageously solid at ambient temperature (23° C.), and is advantageously relatively low melting. The substance may, for example, be of a waxy consistency. Advantageously, its melting point is at most 250° C., preferably at most 150° C., in the form in which it is used in the composition.

The substance advantageously does not react chemically with the other components of the composition at ambient temperature. Similarly, advantageously, the substance does not react with the container (vessel) at ambient temperature, corrosion problems thereby being minimized or avoided. The binder advantageously reduces impact and friction sensitiveness. Further, while the binder is combustible it advantageously does not substantially vary the combustion rate of the composition. Preferably the weight ratio of carbon:hydrogen in the binder is at least 13:1.

As examples of binders, component (a), there may be mentioned biphenyl, naphthalene, diphenylamine, anthracene, and diphenylmethane. Optional substituents on the binder molecule include alkyl, especially $C_1$ to $C_4$ alkyl, alkoxy, especially $C_1$ to $C_4$ alkoxy, and hydroxy, and metal salts of hydroxy, especially the alkali and alkaline earth metal salts.

The oxidizing agent, component b, used in compositions according to the present invention is advantageously a metal peroxide or, more advantageously, a metal or ammonium salt of an inorganic oxygen-containing acid.

As examples of oxidizing agents there may be mentioned metal peroxides, e.g., sodium, potassium, rubidium, cesium calcium, strontium, and barium peroxides; inorganic chlorates, e.g., sodium, potassium, lithium, rubidium, magnesium, strontium, and barium chlorates, inorganic perchlorates, e.g., lithium, sodium, potassium, rubidium, magnesium, calcium, strontium, barium, ferric, and cobalt perchlorates, and metal nitrates, e.g., lithium, sodium, potassium, copper, silver, magnesium, strontium, barium, zinc, aluminum thallium, stannic, bismuth, manganese, ferric, ferrous and nickel nitrates. Also suitable for use are ammonium perchlorate and ammonium nitrate, and other solid salts of peroxy acids.

Among the oxidizing agents above, there are preferred potassium and ammonium perchlorates, ammonium, potassium, strontium, and barium nitrates, and potassium chlorate. The most preferred oxidizing agent is potassium perchlorate either alone or in admixture with one or more other preferred oxidizing agents.

It is within the scope of the invention to use mixtures of any two or more oxidizing agents.

As examples of component (c), the fuel, there may be mentioned aromatic carboxylic acids, their metal salts, and their partial metal salts, for example, potassium benzoate, sodium salicylate, potassium hydrogen phthalate and gallic acid. It is within the scope of the invention, and may be preferred, to employ mixtures of two or more of such materials.

The composition may also comprise materials which upon ignition produce, for example, color, sound, smoke, or large volumes of gas. The composition is advantageously free flowing, and may also contain materials that enhance flow, e.g., silica.

Advantageously, the composition comprises components (a), (b) and (c), in proportions by weight of 1 to 15:55 to 75:25 to 45.

The components of the composition are advantageously each in finely divided form, for example, in the form of fine powders.

The composition may be formed by simply mixing the binder with the other components of the composition, in any order, taking the normal precautions necessary when mixing explosives, for example, working with limited quantities of material at any one time. The resulting mixture is a free flowing product, in powder or granular form, and is not tacky or gelatinous.

Simply mixing the binder with the other components of the composition may, in certain circumstances, give rise to a dusty powder product. Large amounts of dust are generally undesirable, for example, dust may interfere with the operation of the rammer when the composition is being used to fill a container as described below. In such circumstances it may be preferable to form the product into a granulate. The powder is mixed with a small quantity of a 50:50 by volume mixture of water and alcohol (usually ethanol) and then passed through a granulator. The resulting product is in free flowing granular form and is not tacky or gelatinous. Such a granulate produces less dust and so does not interfere so greatly with the operation of the rammer during filling processes.

Of course, it is also possible to take each of the individual components of the composition and add to each a small volume of 50:50 by volume water and alcohol mixture and then mix those together and pass that mixture through a granulator. In that way a granulated product may be formed without the intermediate powder product.

The composition may be readily filled into a container, for example, a rocket motor tube, by conventional procedures. In one such method, a funnel, the narrow end of which is shaped and sized to fit over the upper open end of a motor tube, surrounds a hollow rammer of outside diameter slightly less than the inside diameter of the tube, to allow the powder composition to flow down past it into the tube. The rammer is mounted on an eccentric, and as the powder flows down past the rammer the force of the latter solidifies the powder in the tube. The funnel and tube are moved downward relative to the rammer as the tube fills up, until halted by a trip at the desired level. Upward pressure is exerted on the tube and funnel by, for example, a hydraulic counterbalance. The rammer is hollow to accept a gallery spike, and if desired a choke or constriction is provided at the bottom of the compacted composition.

The tube may also be filled by separate addition of the composition followed by consolidation using hand or machine pressure.

The following Examples, in which parts are by weight unless indicated otherwise, illustrate the invention:

EXAMPLE 1

The following components were mixed and the resulting powdery composition (a "white powder") inserted into the rocket motor tube using the funnel and rammer procedure described above.

A. 60 parts of potassium perchlorate.

B. 40 parts of potassium benzoate.

C. 10 parts of biphenyl.

The following examples of white powder compositions were mixed and filled by the procedure of Example 1:

EXAMPLE 2

A. 60 parts of potassium perchlorate.

B. 40 parts of potassium benzoate.

C. 10 parts of naphthalene.

EXAMPLE 3

A. 60 parts of potassium perchlorate.

B. 40 parts of potassium benzoate.

C. 10 parts of 2-methoxynaphthalene.

EXAMPLE 4

A. 55 parts of potassium perchlorate.

B. 5 parts of potassium nitrate.

C. 40 parts of potassium benzoate.

D. 15 parts of biphenyl.

EXAMPLE 5

A. 45 parts of potassium perchlorate.

B. 15 parts of potassium nitrate.

C. 40 parts of potassium benzoate.

D. 1 part of diphenyl methane.

EXAMPLE 6

A. 45 parts of potassium perchlorate.

B. 25 parts of potassium nitrate.

C. 30 parts of potassium benzoate.

D. 5 parts 2-hydroxybiphenyl.

E. 1 part of silica flow aid.

EXAMPLE 7

A. 50 parts of potassium perchlorate.

B. 20 parts of strontium nitrate.

C. 30 parts of potassium benzoate.

D. 5 parts of naphthalene.

E. 1 part of silica.

EXAMPLE 8

A. 45 parts of potassium perchlorate.

B. 25 parts of potassium nitrate.

C. 30 parts of potassium benzoate.

D. 4 parts of 2-hydroxybiphenyl, sodium salt.

I claim:

1. A solid, flowable, pyrotechnic composition, substantially free from elemental sulphur, comprising (a) an organic substance containing at least one aromatic group, containing carbon and hydrogen in a ratio of at least 10:1 by weight, and having a melting point of more than 150° C., as a binder;

(b) an oxidizing agent; and (c) a fuel.

2. A composition as claimed in claim 1, in which the organic substance is a compound containing carbon and hydrogen in a ratio of at least 10:1 by weight.

3. A composition as claimed in claim 2, wherein the ratio is at least 13:1.

4. A composition as claimed in claim 2, wherein the compound is at least one compound selected from the group consisting of unsubstituted biphenyl, naphthalene, diphenylamine, diphenylmethane, and biphenyl, naphthalene, diphenylamine, anthracene and diphenylmethane substituted by at least one radical selected from OH, OM, alkyl and alkoxy, wherein M represents the equivalent of a metal.

5. A composition as claimed in claim 1, wherein the weight ratio of binder to oxidizing agent is within the range of from 1 to 15:55 to 75.

6. A composition as claimed in claim 1, wherein the oxidizing agent is selected from the group consisting of metal peroxides and metal and ammonium salts of inorganic oxygen-containing acids.

7. A composition as claimed in claim 6, wherein the oxidizing agent is at least one compound selected from the group consisting of potassium and ammonium perchlorate, potassium, ammonium, strontium and barium nitrates, and potassium chlorate.

8. A composition as claimed in claim 1, wherein the fuel comprises an aromatic carboxylic acid, a salt or a partial salt thereof.

9. A composition as claimed in claim 8, wherein the weight ratio of binder:oxidizing agent:fuel is within the range of from 1 to 15:55 to 75:25 to 45.

10. A composition as claimed in claim 8, wherein the acid, salt or partial salt thereof is at least one compound selected from the group consisting of potassium benzoate, sodium salicylate, potassium hydrogen phthalate, and gallic acid.

11. A composition as claimed in claim 1, in powder or granular form.

12. A composition as claimed in claim 1, compacted into a solid mass.

13. A rocket motor, firework or a firework component containing a composition as claimed in claim 12.

14. The composition of claim 1, wherein the binder is substantially free of COOH and $COO^-M^+$ groups, wherein $M^+$ represents the equivalent of a metal ion.

15. The composition of claim 1, wherein the binder is the compound 2-hydroxybiphenyl.

16. A solid, flowable, pyrotechnic composition substantially free from elemental sulphur, comprising:

(i) potassium perchlorate;

(ii) potassium nitrate;

(iii) potassium benzoate; and (v) 2-hydroxybiphenyl.

17. A solid, flowable, pyrotechnic composition substantially free from elemental sulphur, said composition comprising at least three components, one of those components being an organic substance containing at least one aromatic group, which substance contains carbon and hydrogen in a ratio of at least 10:1 by weight, has a melting point of not more that 150° C., acts as a binder and is substantially free of groups of the formulae COOH and $COO^-M^+$, wherein $M^+$ represents the equivalent of a metal ion.

* * * * *

UNITED STATES PATENT AND TRADEMARK OFFICE

CERTIFICATE OF CORRECTION

PATENT NO. : 5,525,166

DATED : June 11, 1996

INVENTOR(S) : Barry COOK

It is certified that error appears in the above-indentified patent and that said Letters Patent is hereby corrected as shown below:

On the title page, item [54] and column 1, line 1:

Change " PRYOTECHNIC " to read - - PYROTECHNIC - -.

Claim 1; column 5, line 22:

Before "more" add - - not - -.

Signed and Sealed this

Eighteenth Day of February, 1997

*Attest:*

*Attesting Officer*

BRUCE LEHMAN

*Commissioner of Patents and Trademarks*